United States Patent [19]

Weaver

[11] 4,022,125

[45] May 10, 1977

[54] DAMPENING APPARATUS FOR OFFSET PRINTING

[76] Inventor: Gaylon N. Weaver, 3930 Villanova, Houston, Tex. 77005

[22] Filed: July 7, 1975

[21] Appl. No.: 593,541

[52] U.S. Cl. ..... 101/148; 29/132; 101/451

[51] Int. Cl.[2] ..... B41L 25/02

[58] Field of Search ..... 101/451, 148, 350, 362; 29/132

[56] References Cited

UNITED STATES PATENTS

| | | | |
|---|---|---|---|
| 2,102,641 | 12/1937 | Osborne | 101/148 |
| 2,119,491 | 5/1938 | Rapport | 29/132 X |
| 2,309,729 | 2/1943 | Gordon | 101/368 X |
| 2,530,282 | 11/1950 | Brodie et al. | 101/350 |
| 3,002,866 | 10/1961 | Gartrell et al. | 29/132 X |
| 3,007,403 | 11/1961 | Barnes | 101/148 |
| 3,094,065 | 6/1963 | Roberts | 101/148 |
| 3,254,515 | 6/1966 | Schiffer | 29/132 X |
| 3,594,255 | 7/1971 | Budinger | 101/148 X |
| 3,688,694 | 9/1972 | Preuss et al. | 101/148 |
| 3,902,417 | 9/1975 | Fischer | 101/148 |

*Primary Examiner*—Clyde I. Coughenour

*Attorney, Agent, or Firm*—James L. Jackson

[57] ABSTRACT

The dampening system incorporates a fountain roller that removes a quantity of dampening liquid from a reservoir and transfers a portion of the liquid to a ductor roller composed of a soft material such as synthetic rubber and having a smooth outer surface is supported by the framework of the machine and is intermittently moved laterally into engagement with the fountain roller in order to extract a quantity of dampening liquid from the fountain roller. A rider roller composed of hard non-metallic material, such as polyurathane or other suitable plastic material, is intermittently engaged by the ductor roller to transfer a quantity of the dampening liquid from the ductor roller to the rider roller. The rider roller is provided with a smooth cylindrical outer surface. A dampening form roller, composed of a soft material such as synthetic rubber, is disposed in engagement with the rider roller and with the photographic printing plate carried by the plate cylinder of the machine and is operative to transfer a measured quantity of the dampening liquid from the rider roller to the photographic printing plate to prepare the printing plate to accept ink only in those portions that are specifically prepared to receive it.

12 Claims, 3 Drawing Figures

DAMPENING APPARATUS FOR OFFSET PRINTING

FIELD OF THE INVENTION

This invention relates generally to offset printing and more specifically relates to offset printing utilizing printing machines incorporating non-integrated ink systems wherein the dampening liquid is not applied with the ink, wherein the dampening liquid is not applied with the ink, but rather is separately transferred from a dampening liquid reservoir to the photographic printing plate while ink is separately transferred from an ink reservoir to the photographic printing plate. Even more specifically, the present invention is directed to the provision of dampening liquid transfer system incorporating a novel rider roller structure that promotes precisely controled transfer of dampening liquid to the photographic printing plate so as to promote efficient low cost printing operations and at the same time accomplish sharper and clearer printing that is ordinarily available through the use of offset printing machines.

BACKGROUND OF THE INVENTION

In offset printing, when printing machines are utilized having non-integrated ink and dampening liquid systems, it is typical to provide a plurality of ink roller devices that interact to transfer ink from an ink reservoir to a rotating photographic printing plate and it is also typical to provide a dampening liquid supply system that applies dampening liquid to the printing plate. The dampening liquid supply system typically incorporates a plurality of inter-engaging rollers that trasfer a dampening liquid to the photographic printing plate. The dampening liquid serves to coat the photographic printing plate with a precise quantity of the dampening liquid or solution that causes ink to be repelled only on those portions of the printing plate that have not been specifically prepared to receive the ink. With the ink deposited on the specific portions of the printing plate, paper stock is fed from a paper supply through the printing machine where it comes into contact with the blanket of a blanket roll, which blanket receives the image to be printed from the rotating printing plate. Transfer of the ink is accomplished from the specifically prepared portions of the printing plate to the blanket roll and then to the paper or other sheet stock to be printed.

It is also typical to provide a fountain roller having a portion thereof located within a fountain reservoir that contains a quantity of dampening liquid with the quantity of liquid within the fountain reservoir remaining essentially constant. The fountain roller is typically formed of aluminum and will typically have a smooth outer periphery. A ductor roller is supported by the framework of the machine not only for rotation but also for transverse movement. The ductor roller comes into contact with the fountain roller at one extremity of its lateral travel and at the other extremity of its travel comes into contact with the outer surface of a rider roller. The ductor roller and the rider roller are typically formed of a soft rubberlike material such as synthetic rubber having a hardness of approximately thirty durometer. A form roller is maintained in co-rotating engagement with the rider roller and also with the photo-graphic printing plate carried by the rotating plate cylinder. The form roller is typically composed of the same soft rubberlike material as the ductor and rider rollers, but is typically provided with a dampening roller sleeve that has the capability of retaining a large quantity of dampening liquid to the photographic printing plate.

Dampening system rollers of offset printing machines

Dampening system rollers of offset printing machines are typically composed of solid metal while the ductor roller adjacent thereto is typically formed of soft material with a cloth covering applied thereto to assist in retention and distribution of the dampening liquid. The oscillator roller is typically composed of aluminum and the form roller, also frequently referred to as the dampening roller of the dampening system, is a soft roller that is covered with a dampening liquid retaining sleeve. One type of liquid retaining sleeve is referred to as the Molleton cover, which is formed of a fabric material that retains the dampening liquid but, when wet or damp, is very slow to attract ink. Molleton covers come in many varieties and may be purchased ready cut for the form rollers of printing presses in tubular or wraparound strip form, or in continuous rolls of tubular material. Some of the sleeves incorporate and elastic material that retains the sleeve in assembly with the roller and in other cases, the sleeves are provided with tying strings that are used to tighten the sleeves on the rollers. Although a greater quantity of Molleton covers are utilized in offset printing presses than other dampening devices, other liquid retaining covers, such as fiber covers are also employed which serve to reatin a quantity of dampening liquid for the purpose of coating the printing plate as it rotates in contact with the dampening form roller.

One of the major problems with Molleton covers, which problem is eliminated to some extent by fiber covers, is the fact that the Molleton sleeve, being composed of a fabric material, will bulge to some extent in the area of contact with the rider roller and with the rotating photographic plate. Bulging of the fabric material can cause the photographic plate to be smeared to some extent and this causes the image printed to be less than sharp and precise. The fiber covers are typically not subject to excessive bulging and, when utilized with a matching sized dampening roller, insure fairly good printing performance. Because of the difficulty installing and caring for fiber covers for dampening rollers, Molleton covers are much more widely utilized in the printing industry at the present time.

Another problem encountered when utilizing Molleton covers for dampening form rollers of offset printing presses is the problem caused by lint that comes off the dampening form roller during the printing process. Loose lint can cause inaccuracies in the printing process and can result in a large amount of wasted paper stock and ink waste in order to provide a customer with quality printing work.

The farbic or cloth material of the Molleton covers, as well as the softeness of the fiber covers that are presently utilized in the dampening systems of offset printing presses, will not typically allow printing work to be as sharp and precise as might otherwise be desirable. The dampening covers, because of their need to retain a quantity of dampening liquid for efficient coating of the rotating photographic printing plate will, because they are composed of soft fabric or fibrous material, cause some smudging of the plate which prevents the linework being printed from being as sharp and clear as might otherwise be desirable. Moreover, when printing large areas of solid black, the Molleton and fiber covers provide limitations to the particular size of the area that can be printed. For example, when printing solid black areas, efficient printing can be obtained when the size of the area being printed is restricted to approximately 3 inches or so. As will be explained herein below, the present invention effectively provides a printing technique whereby solid black areas in the order of 6 inches may be efficiently printed without any sacrifice whatsoever from the standpoint of clarity and accuracy.

Another major problem encountered when utilizing Molleton covers and also encountered to a certain extent when utilizing dampening roller covers composed to synthetic fiber, is the amount of "run in" time that is necessary to cause the dampening liquid content of the dampening roller sleeve to be optimum for accurate printing. To insure that dampening covers and photograhic printing plates do not pick up a quantity of ink when the printing press is initiated with improperly moistened covers, it is typically the practice in the industry either to initially moisten the covers by hand or, which is more preferred, to run the printing machine for approximately fifteen minutes or so to allow the dampening system of the machine to achieve the right moisture content. Where the dampening covers are moistened by hand, it is very easy for the coves to become excessively wet. When this occurs, it is necessary either to allow the machine to remain idle for an hour or two to allow the covers to loose some of the moisture or to run a quantity of paper through the machine to allow the paper to absorb the excessive moisture. It is not unusual for an operator to run 200 sheets of paper through the machine before the moisture content of the dampening roller covers reaches the lever for optimum printing. This of course is wasteful, not only because of the paper that is wasted, but also because of losses caused by down-time on the machine. It is of course desirable to limit the amount of downtime and the amount of run in time that is necessary to produce optimum printing impressions.

It is also desirable to reduce as much as possible the number of printing copies that are made before the printing machine is properly adjusted to produce quality prints. In the past, using Molleton covers and fiber covers, a large number of copies were necessary before the ink an moisture content applied to the printing plate could reach an optimum level. It is not unusual for an operator to run from 100 to 200 printing sheets before quality printing is achieved. This is undesirable from the standpoint of paper waste as well as waste of machine and employee printing time. As will be explained in detail hereinbelow, the present invention effectively promotes very low waste of paper and employee printing time to achieve optimum printing when a printing run is initiated. For example, efficient printing may be accomplished after approximately five sheets of paper have been run, because of the simplicity of machine adjustment that is achieved by utilzng the dampening roller system of the present invention. In addition, the run in time for initiating a printing operation can be very low or practically non-existent when the present invention is utilized in connection with offset printing presses having non-integrated dampening liquid and ink systems. In Accordance with the context of the present invention, the term "non-integrated system" or "non-integrated ink/dampening liquid system " is intended to refer to those types of offset printing machines that accomplish printing with the supply of ink and the supply of dampening liquid being maintained separately and applied separately to the rotating photographic printing plate. By the term "integrated system" those offset printing machines that are referred to incorporate ink and dampening liquid systems, whereby the ink and dampening liquid are placed onto the photographic printing plate simultaneously. The present invention functions efficiently and produces novel results when utilized in context with non-integrated systems, but does not apply to integrated systems.

Offset printing presses are widely utilized to accomplish multi-colered printing. When this is done, the paper being printed is processed through the printing machine once for each of the particular colors being printed if the printing machine has only a single cylinder. Because of the likeklihood that Molleton covers and fiber covers for the rotating dampening form rollers will pick up a quantity of ink during any particular printing process, it is virtually necessary that the covers be changed between each of the colors being printed. This, of course, causes excessive machine downtime and is also quite expensive because the Molleton covers frequently have a cost in the order of five dollars each. It is therefore desirable to provide an efficient dampening system that can be quitely cleaned in order to provide for printing of different colors without necessitating change of the covers of the dampening rollers between the printing of each color.

It is therefore a primary feature of the present invention to provide a novel dampening system for offset printing presses whereby Molleton and fiber covers for the dampening rollers are eliminated, thereby also eliminating the cost in the form of purchasing, installation, removal, cleaning and breaking in of the Molleton covers.

It is a further feature of the present invention to provide a novel dampening system for offset printing presses that effectively allows run in time and preliminary paper runs to be maintained as low as possible to achieve efficient productive printing.

It is also an important feature of the present invention to provide a novel dampening system for offset printing presses when problems of printing inaccuracy caused by lint or caused by smudging contact between soft fabric or fiber dampeing covers and photograhic plate are effectively eliminated.

Among the several features of the present invention is noted the contemplation of a novel dampening system for offset printing presses whereby extremely sharp and precise printing is accomplished through the use of offset printing presses having non-integrated systems.

It is also a feature of the present invention to provide a novel dampening system for offset printing presses whereby presently existing offset printing presses having non-integrated ink and dampening liquid systems can be efficiently modified in a few minutes time to covert the same to accomplish printing within the spirit and scope of the present invention.

It is also a feature of the present invention to provide a novel printing process for offset printing presses having non-integrated ink and dampening liquid systems whereby soft, rubber, smooth surfaces ductor and form rollers are employed, with a hard and smooth non-metal roller provided therebetween and for contact therewith to accomplish efficient metering of dampening liquid to the photographic printing plate and applying and dampening liquid to the photographic printing plate in such a manner that no smudging takes place and the images printed are therefore sharp, precise and free from the distortion that is typically caused by Molleton or fabric covers.

Other and further objects, advantages and features of the present invention will become apparent to one skilled in the art upon full consideration of the present disclosure. The form of the invention, which will now be described in detail, illustrates the general principals of the invention, but it is to be understood that this detailed description is not to be taken as limiting the scope of the present invention.

SUMMARY OF THE INVENTON

A preferred embodiment of the present invention may conveniently take the form of a dampening roller system for offset printing purposes wherein all of the rollers of the dampening roller system have relatively smooth surfaces. A ductor roller and a form roller may be employed that have outer peripheral portions that are defined by rubber or any one of a number of soft rubberlike materials having a hardness in the order of thirty durometer. Between the ductor roller and the dampening form roller may be provided a rider or oscillating roller having a smooth outer peripheral portion defined of a hard-non-metallic material such as polyurathane, Nylatron or any one of a number of suitable plastic materials having a hardness range in the order of from 80 durometer to 120 durometer.

The rider roller is in continuous rotating engagement with the form roller and is in intermittent rotative engagement with the ductor roller which moves back and forth in a lateral direction for intermittent contact with both the ductor roller and with the fountain roller. The rider or oscillating roller also has constant co-rotative engagement with a form roller that is composed of soft rubber or rubberlike material, which form roller also has co-rotative engagement with a plate cylinder which carries the photographic plate from which the printing image is obtained. The form roller is in actual corotating contact with the photographic plate being carried by the plate cylinder. Because all of the rollers have smooth cylindrical surfaces, water transfer through the dampening roller system to the photographic printing plate can be very accurately maintained and can be very accurately controlled by simple adjustment of the various rollers. The fountain roller can have a knurled peripheral surface but tests indicate a substantial improvement in printing quanlity if smooth surfaced fountain rollers are utilized.

Even though the dampening roller system may become excessively wet, only a few sheets of paper need to be printed in order to cause the machine to remove the excessive moisture and cause further printing to be accomplished with optimum and evenly distributed moisture content being applied to the photographic printing plate carried by the plate cylinder.

The extremely smooth, hard and durable outer portion of the rider or oscillating roller causes an optimum roller enagement relationship to be developed between the rider roller and the adjacent ductor and form rollers. This feature allows moisture to be evenly distributed over the entire surface areas of the dampening rollers and causes a finely beaded enve distribution of water onto the photographic printing plate.

The hard durable rider or oscillating roller is to be inked along with the form roller preliminary to initiation of a printing process. The lubricant quantity of ink prevents wear of the form roller or the oscillating roller and effectively allows these rollers to remain servicable for extremely long periods of time. The lubricant film caused by the ink also causes beading of the dampening liquid droplets which is essential to efficient distribution of the dampening liquid on the rollers.

The rider roller also prevents distortion of the ductor roller and the form roller because of the structural integrity it offers to the peripheral protions of the soft rollers. There is little tendency for the soft rollers to swell at the end portions or to become worn such that unevenness occurs because of the structural integrity and support offered by the hard oscillating roller.

BRIEF DESCRIPTION OF THE DRAWINGS

So that the manner in which the above recited features, advantages and objects of the present invention, as well as others which will become apparent, are attained and understood in detail, more particular description of the invention, briefly summarized above, may be had by reference to the embodiment thereof which is illustrated in the appended drawings, which drawings form a part of this specification.

It is to be noted, however, that the appended drawings illustrate only a typical embodiment of the invention and are therefore not to be considered limiting of its scope, for the inventon may admit to other equally effective embodiments.

IN THE DRAWINGS

Figure 1:
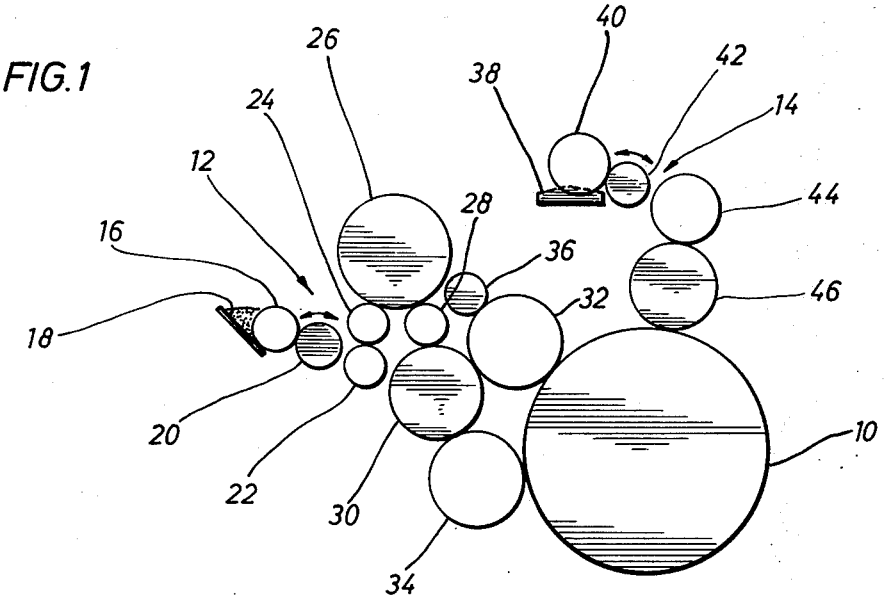

FIG. 1 is a schematic elevational view of the ink and dampening fluid distribution systems of an offset printing press utilizing the dampening fluid distribution system of the present invention.

Figure 2:
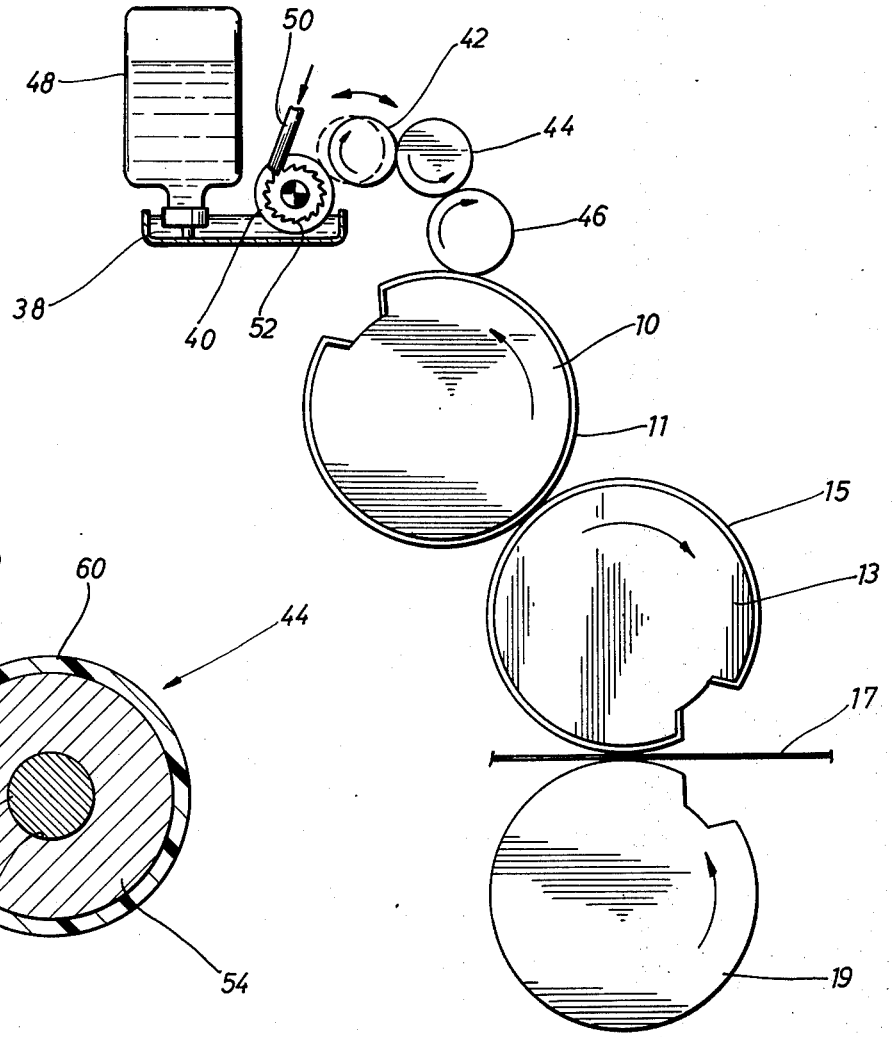

FIG. 2 is a schematic illustration in elevation showing the dampening roller system of FIG. 1 in greater detail.

Figure 3:
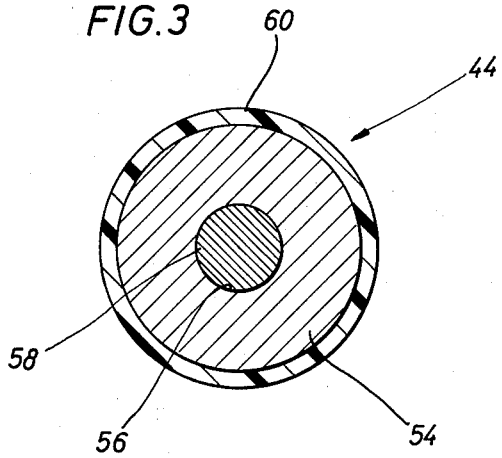

FIG. 3 is a sectional view of the oscillator roller of the dampening roller system of the present invention.

DESCRIPTION OF PREFERRED EMBODIMENT

Referring now to the drawings and first to FIG. 1, there is shown in schematic for a printing machine arrangement of the offset printing type wherein a rotating plate cylinder 10 is adapted to receive a photographic printing plate that is formed about the plate cylinder and is rotated along with the plate cylinder during operation of the machine. Also shown in FIG. 1 is an ink distribution system, illustrated generally at 12, for applying ink to the photographic plate carried by the plate cylinder 10 and a dampening liquid distribution system, illustrated generally at 14, that is provided for the purpose of supplying dampening liquid to the photographic printing plate in evenly distributed form. A blank roll 13, covered with a rubber blanket 15 rotates with the plate cylinder 10 and receives the image to be printed from the plate cylinder. Paper 17 picks up the image from the blanket roll as it passes between the blanket roll and an impression roll 19.

The dampening liquid causes the photographic printing plate to retain printing ink only in those places on the plate that have been specifically prepared to receive the ink, thereby providing an ink image that may be transferred to a sheet of paper stock that passes through the machine and comes into contact with the blanket of a blanket roll that receives the image to be printed from the photographic printing plate carried by the plate cylinder. Obviously, other offset print type printing machines may utilize different ink supply systems and dampening liquid distribution systems and therefore FIG. 1 is representive only of an offset printing machine of one particular acceptable type.

Under the context of the present invention, it is intented that that invention relate only to offset printing press machines having a non-integrated ink and dampening liquid supply systems, whereby ink and dampening liquid are separately applied to the photographic printing plate. Those offset printing pressures having integrated ink and dampening liquid supply systems where the ink and dampening liquid are applied simultaneously to the photographic printing plate carried by the plate cylinder are beyond the scope of the present invention.

As illustrated in FIG. 1, the ink supply system may include an ink fountain roller 16 that extracts ink from an ink supply reservoir 18. An ink ductor roller 20 is adapted to intermittently engage the ink fountain roller 16 and an ink distributor roller 22 to provide the ink distributor roller with a measured quantity of ink. An ink distribution roller 24 serves to transfer the ink from the roller 22 to a top oscillating roller 26 that is capable of shifting laterally as well as rolling in a co-rotative relationship with the ink distribution roller 24. Another ink distribution roller 28 receives ink from the top oscillating roller 26 and transfers it to a main oscillating roller 30 which in turn then transmits the ink to upper and lower ink form rollers 32 and 34 respectively. Roller 36, in contact with the upper ink form roller 32, also serves as an ink distribution roller. The various ink distribution rollers serve to properly coat the main oscillating roller and the upper and lower ink form rollers with an optimum coating of ink that is transferred to the photographic printing plate carred by the plate cylinder as the plate is co-rotated relative to the rollers 32 and 34.

In no dampening liquid system were available, the entire photograhic printing plate would become coated with ink from the rollers 32 and 34 in a very short time and prining would not be possible. Offset printing is achieved when the rotating photographic printing plate is coated with a quantity of dampening liquid, which is typically referred to in the industry as water, dampening solution, dampening liquid, fountain solution, etc. The function of the offset printing press dampening solution, according to *Photo Offset Fundamentals* by John E. Cogoli, published in 1960 by McKnight and McKnight Plublishing Company of Bloomington, Illinois, is to furnish a mildly-acidic wetting agent to the offset plate surface during the press run, to keep the clear (nonprinting) areas of the plate free of ink. This solution sometimes is refered to as the "water" or "damperer" solution. The dampening solution can vary substantially, depending upon the type of printing that is to be done but, regardless of the characteristics of the dampening solution, its function is the same in all offset printing machines.

In the dampening liquid supply system 14 shown in FIG. 1, there is provided a dampering liquid reservoir 38 that typically contains a measured quantity of dampening liquid. A fountain roller 40 is rotatably supported by the roller support framework of the printing machine end is located so that the outer periphery of the roller 40 passes through the reservoir 38 and picks up a small quantity of the dampening liquid contained within the reservoir on each revolution thereof. A water ductor roller 42 is also supported by the framework of the printing press and is capable not only of rotating but also moving laterally into contact with the fountain roller 40 and with a rider on oscillating roller 44. The oscillating roller, as is the fountain roller 40 in conventional offset printing machines, typically composed of metal such as aluminum to repel ink. In accordance with the present invention, however, the rider roller 44 is composed of a relatively hard non-metal material such as polyurathane, Nylatron or any one of a number of acceptable non-metallic materials. The dampening roller 44 is also of sufficient structural integrity that it will provide optimum stable engagement with the ductor roller 44 and with a dampening liquid form roller 46 that is disposed in corotatable engagement with the rider roller 44. The dampening liquid roller 46, like the ductor roller 42, is composed of a soft rubber material in the order of 20 to 40 durometer while the non-metallic rider roller 44 is composed of a non-metallic mateial having a hardness range in the order of 80 durometer to 100 durometer. THe purpose of providing a hard oscillator roller is to prevent the oscillator roller shifts from inking up during printing operations.

Referrng now to FIG. 2, the dampening liquid system for the offset printing press is shown in greater detail with the level of liquid being maintained in the reservoir 38 by means of a fountain solution container 38 that adds liquid to the reservoir 38 when the level becomes lower than is desirable. The fountain roller 40 is movable in increments by means of a reciprocating pawl 50 that engages a gear wheel 52. The ductor roller 42 is shiftable as shown in full and broken lines.

As illustrated in FIG. 3, the rider roller, shown generally at 44, may incorporate a structural core 54, such as may be defined by metal such as steel for example. Within the core 54 may be formed an elongated axial bore 56 that may receive a scroll shaft 58 that is non-rotatively retained in relationship to the support framework of the printing press. The core 54 is rotatable about the stationery scroll shaft 58. The structural core 54 and the scroll shaft 58 interfit in a conventional manner and interact in such manner as to cause axial shifting of the core 54 as it rotates relative to the scroll shaft. The scroll shaft and its driving connection with the structural core 54 are of conventional nature.

As illustrated in FIG. 3, the structural core 54 may be provided with an outer covering of non-metallic material 60 which may conveniently take the form of a sleeve of polyurathane or any one of a number of other acceptable rather hard plastic materials. The non-metallic sleeve 60 may be bonded in any suitable manner to the metal core 54 and, machined or grount to an extremely smooth outer cylindrical surface that engages the ductor and form rollers of the dampening liquid distribution system.

Because the outer covering 60 of the oscillating rider roller 44 has frictional shifting engagement with the form roller, it is necessary to provide a ceratain degree of lubrication in order to provide either the form roller or the rider roller from becoming excessively worn. It is necessary that the various rollers of the dampening liquid system be coated with ink to prevent unnecessary wear of the form and oscillator rollers and even though the rollers will pick up ink naturally through operation of the machine, it is typically the practice according to this invention to provide the rollers of the dampening system with an ink coating as a preliminary step to printing operations.

OPERATION

When a printing operation is initiated, it is first required that the various ink distribution rollers be completely coated with ink and that the dampening liquid distributionrollers be also provided with a coating of ink. Conventionally, where Molleton covers are utilized on the dampening form roller of offset printing machines, it is necessary to wet the Molleton covers to an optimum degree with the dampening liquid. Applying the liquid directly to the Molleton covers in a manual operation generally results in application of excessive liquid that must be removed. Also, the dampening liquid may be unevely applied to the printing plate, causing uneven printing to occur. Because the Molleton covers are designed to retain the liquid, it is necessary either to allow the covers to dry to reach an optimum wetness, which can take from 1 to 2 hours time or in the alternative, a large number of paper sheets may be run through the machine to remove the excessive dampening liquid. As indicated above, it may be required that 100 to 200 sheets of paper be run through the machine before the machine reaches optimum printing capability. The usual practice in the industry is for the printing machine to be operated for approximately fifteen minutes before a printing operation is initiated. This period of time is known in the industry as "run-in-time" and, of course, it is necessary but undesirable because of the loss of production encountered. Obviously the printing machine must be "run-in" after the machine has sat idle for a while and each time the Molleton covers are changed and, in the case of multicolor printing, the machine must be run in between each change of color.

With the present invention being employed, there is no Molleton cover or fiber cover to retain a large amount of moisture and, even though the dampening liquid may be applied directly to the rollers of the machine, it will very quickly be dissipated simply by running a small number, say three to five sheets, of paper through the machine. Because the various rollers of the dampening roller system can be very accurately adjusted, because of the absence of Molleton or fiber covers, the transfer of dampening liquid from the dampening roller system to the photographic printing plate can be effectively controlled with great precision. Moreover, the soft rubber form roll, receiving an evenly dispered accurate and finely beanded coating of dampening liquid, will provide the same finely beaded and evenly distributed coating of dampening liquid to the photographic printing plate. Since the photograhic printing plate will be effectively coated with evenly distributed, closely spaced extremely fine beads of dampening liquid and since there is no possibility of incorporating any lint or any lint created irregularities in the application of dampening liquid to the photographic printing plate, the images that will appear upon the paper or other material being printed will be extemely sharp and clear. The images printed will be free of irregularities that are created by lint from the Molleton or fiber covers or created by the soft fibers of the Molleton and fiber covers.

The rider or oscillating roller of the dampening liquid system, because of its low fricton relationship with the form roller and with the ductor roller, will, upon the rollers receiving a very light slightly oily film from the ink utilized in the printing process, have a light relatively friction free sliding engagement with the ductor and form rollers. The presence of the oily film will result in extremely light or negligible wear on the roller system. In fact, it has been determined through tests that dampening liquid distribution systems constructed in accordance with the present invention will vastly outperform conventional dampening roller systems from the standpoint of service life. Not only is the rider roller virtually free from wear, because of its typically hard and wear resistance outer portion, but also the soft rubber rollers tend to resist wear to the point that the service life thereof is considerably extended. The structural integrity offered by the hard surfaced rider roller effectively retards the usual tendency of the end portions of the soft rollers to swell through normal use to the point that frequence replacement is necessary.

The invention has effective application not only for providing new printing machines with enhanced printingcapability, becuase of the novel features accomplished by the dampening roller system of the present invention, but also has effective application in existing printing machines. The dampening roller system of the present invention may be simply and quickly substituted for the dampening roller system of conventional printing machines by simply exchanging the various dampening rollers. Because it is not necessary to provide the form roller with a capability of receiving and retaining a Molleton cover or any other type of cover for retaining a quantity of the dampening solution, the various rollers that are supplied may be of slightly different size than the existing rollers of the machine but, when assembled into the machine may be very simple and efficiently adjusted to provide optimum peripheral contact between the various rollers.

It is not necessary to go through the usual task of adjusting the compressive engagement or spacing of the various rollers through the use of adjustment strips of paper. Adjustment can be accomplished simply by bringing an inked form roller into contact with the dry printing plate which causes an ink stripe to be deposited onto the plate. If the stripe is of proper width, for example, one eighth to three sixteenth of an inch in width and if the width of the stripe is consistent along its length, the rollers of the dampening system will be properly adjusted. Presently existing offset printing machines can be very simply and efficiently converted to the use of the dampening roller system of the present invention simply by installing a roller package including the ductor roller, the rider roller and the form roller and fountain roller.

It has also been determined through tests that the dampening roller system of the present invention will clean the printing plate while the machine is running, thus eliminating the need to clean the plate with cleaning solution. Where Molleton covers are employed, running a printing machine with insufficient dampening liquid being applied to the photograhic printing plate will cause the photographic printing plate and the form roller to be excessively coated with ink. It is necessary then to remove the Molleton cover and replace it with a clean cover and to clean the photographic plate with solution, after which the machine can be placed back into printing operation, assuming sufficient dampening liquid is being applied to the photographic printing plate. This is an inefficient and time consuming task. In the case of the present invention, when insufficient dampening liquid is being applied to the photographic printing plate, the printing plate and the form roll will become coated with ink in the usual manner. If the dampening liquid application system is then started, continued operation of the machine will cause the excessive ink to be lifted from the photographic printing plate and from the form roll. Alternatively, excessive ink can be removed from the form roll and from the photophgraphic printing plate simply by running the machine with sufficient dampening liquid. It is not necessary to remove the form roller to again place the roller system and photgraphic printing back into clean condition for optimum printing. The self-cleaning feature is important primarily from the standpoint that the printing machine is quickly corrective in the event excessive ink should be deposited on the photographic printing plate for any particular reason. Molleton covers, on the other hand, continue to pick up small quantities of ink during operation and must be frequently removed and replaced with clean covers to maintan optimum printing capability.

From the foregoing, it is clearly apparent that a novel dampening system has been provided for offset printing machines having non-integrated ink and dampening liquid distribution systems. The invention, therefore, is one well adapted to obtain all of the features and advantages hereinabove set forth, together with other advantages which will become obvious and inherent from a desciption of the apparatus itself. It will be understood that certain combinations and sub-combinations are of utility and may be employed without reference to other features and sub-combinations. This is contemplated by and is within the scope of the present invention.

As many possible embodiments may be made of this invention without deparating from the spirit or scope thereof, it is to be understood that all matters hereinabove set forth or shown in the accompanying drawings are to be interpreted as illustrative and not in a limiting sense.

What is claimed is:

1. A dampening system for offset printing machines incorporating non-integrated ink systems and having a rotatable plate cylinder for rotating a photograhic printing plate and having an ink supply system for coating specific portions of a photographic printing plate carried by said plate cylinder upon rotaton of said plate cylinder, said dampening system comprising:

a dampening roller framework being connected to said printing machine;

dampening liquid supply means supported by said framework;

a fountain roller having supported by said framework and receiving dampening liquid from said damping liquid supply means;

a ductor roller having a yieldable peripheral surface being rotatably supported by said framework adjacent said fountain roller and being adapted for lateral reciprocating movement into engagement with said fountain roller to remove a quantity of dampening liquid from said fountain roller;

a rider roller being supported by said framework adjacent said ductor roller and being intermittently engaged by said ductor roller to intermittently transfer dampening liquid from said ductor roller to said rider roller, said rider roller having a smooth cylindrical relatively unyielding non-metallic non-abosrbent outer peripheral surface and imparting driving rotation to said ductor roller;

a dampening form roller having a smooth yieldable outer peripheral surface, and being supported by said framework with the outer periphery thereof in engagement with said rider roller and with said printing plate, said rider roller, dampening form roller and plate cylinder revolving at substantially the same peripheral speed and said rider roller and dampening form roller having a touching low mechanical driving pressure relationship therebetween; and said dampening form roller receiving dampening liquid from the said rider roller and applying said dampening liquid to said printing plate in evenyl distributed finely beaded form, said dampening liquid substantially preventing transfer of ink from said printing plate to said dampening form roller.

2. A dampening system as recited in claim 1, wherein:

said peripheral portion of said rider roller is composed of a relatively hard non-metallic material

3. A dampening system as recited in claim 1, wherein:

said peripheral portion of said rider roller is composed of relatively hard plastic material.

4. A dampening system as recited in claim 1, wherein:

said peripheral portion of said rider roller is composed of hard plastic material.

5. A dampening system as recited in claim 1, wherein: said rider roller comprises:

a metal core being rotatably supported by said framework; and a relatively unyieldable non-metallic peripheral sleeve element being disposed about said metal core and defining a smooth cylindrical outer periphery.

6. A dampening system as recited in claim 1, wherein said rider roller comprises:

a structural core being rotatably supported by said framework; and a covering of hard non-metallic material being formed about said structural core.

7. A dampening system as recited in claim 6, wherein:

said coating is composed of Nylon and is formed on said structural core; and said structural core is formed of metal.

8. A dampening system for offset printing machines incorporating non-integrated ink systems and having a rotatable plate cylinder for rotating a photograhic printing plate and having an ink supply system for coating specific portions of a photograhic printing plate carried by said plate cylinder upon rotation of said plate cylinder, said dampening system comprising:

a roller framework being connected to said printing machine;

dampening liquid supply means support by said framework for receiving a quantity of dampening liquid;

a fountain roller being supported by said framework and receiving dampening liquid from said dampening liquid supply a ductor roller being supported by said framework adjacent said fountain roller, said ductor roller having a soft non-absorbent exterior portion and being adapted for lateral reciprocating movement into engagement with said fountain roller to transfer a quantity of dampening liquid from said fountain roller to said ductor roller;

a rider roller supported by said framework adjacent said ductor roller, said rider roller having a hard non-metallic exterior portion and being intermittently engaged by said ductor roller during opertion of said printing machine to transfer a coating of said dampening liquid from said ductor roller to said rider roller, said rider roller oscillating linearly during operation of said printing machine and rotating at substantially the same velocity as the velocity of said plate cylinder; and a dampening form roller having an exterior portion composed of soft non-absorbent material and being supported by said framework with said exterior portion in continuous low mechanical pressure touching and driving engagement with said rider roller, said dampening form roller being in continuous engagement with said photographic printing plate, said dampening form roller and said rider roller rotating at substantially the same velocity as said plate cylinder and transferring a quantity of said dampening liquid from said rider roller to said photograhic printing plate and retarding transfer of ink from said plate cylinder to said dampening form roller.

9. A dampening system as recited in claim 8, wherein:

the hardness range of said ductor roller and said dampening form roller is in the range of from 20 durometer to 50 durometer; and the hardness range of said rider roller is greater than 50 durometer.

10. A dampening system as recited in claim 9, wherein:

said exterior portions of said ductor roller and said dampening form roller are composed of synthetic rubber; and said exterior portion of said rider roller is composed of a hard plastic material.

11. A dampening system as recited in claim 11, wherein: said rider roller comprises:

a metal core being rotatably support by said framework; and said exterior portion of said rider roller being a hard non-metallic sleeve secured about the exterior of said metal core.

12. A dampening system as recited in claim 11, wherein:

said sleeve is formed about the exterior portion of said metal core.

* * * * *

UNITED STATES PATENT OFFICE

CERTIFICATE OF CORRECTION

Patent No. 4,022,125 Dated May 10, 1977

Inventor(s) Gaylon N. Weaver

It is certified that error appears in the above-identified patent and that said Letters Patent are hereby corrected as shown below:

| | |
|---|---|
| Column 1, Line 34: | "trasfer" should read "transfer" |
| Column 1, Line 67: | "photo-graphic" should read "photographic" |
| Column 2, Line 4: | between "liquid" and "to" insert "in order to provide for proper distribution of dampening liquid" |
| Column 2, Line 7: | Delete line 7 |
| Column 2, Line 22: | "wraparound" should read --wrap-around --. |
| Column 2, Line 23: | "and" should read "an" |
| Column 2, Line 45: | between "difficulty" and "installing" insert "of" |
| Column 2, Line 57: | "farbic" should read "fabric" |
| Column 2, Line 58: | "softnss" should read "softness" |
| Column 3, Line 27: | "coves" should read "covers" |
| Column 3, Line 36: | "lever" should read "level" |
| Column 3, Line 47: | "an" should read "and" |
| Column 3, Line 59: | "utilzng" should read "utilizing" |
| Column 3, Line 65: | "Accordance" should read "accordance" |
| Column 4, Line 14: | "multi-colered" should read -- multi-colored |
| Column 4, Line 17: | between "single" and "cylinder" insert "plate" |
| Column 4, Line 18: | "likeklihood" should read "likelihood" |
| Column 4, Line 27: | "quitely" should read "quickly" |
| Column 4, Line 59: | "covert" should read "convert" |
| Column 5, Line 14: | "INVENTON" should read -- INVENTION -- |
| Column 5, Line 50: | "quanlity" should read "quality" |
| Column 5, Line 54: | Delete "to" |
| Column 5, Line 61: | "enagement" should read "engagement" |
| Column 5, Line 65: | "enve" should read "even" |
| Column 6, Line 10: | "protions" should read -- portions --. |
| Column 6, Line 55: | "blank" should read "blanket" |
| Column 7, Line 6: | "that that" should read "that the" |
| Column 7, Line 10: | "pressures" should read "presses" |

UNITED STATES PATENT OFFICE
CERTIFICATE OF CORRECTION

Patent No. 4,022,125 Dated May 10, 1977

Inventor(s) Gaylon N. Weaver

It is certified that error appears in the above-identified patent and that said Letters Patent are hereby corrected as shown below:

| | |
|---|---|
| Column 7, Line 35: | "carred" should read "carried" |
| Column 7, Line 38: | "In" should read "If" |
| Column 7, Line 41: | "prining" should read "printing" |
| Column 7, Line 49: | "plublishing" should read "publishing" |
| Column 7, Line 53: | "refered" should read "referred" |
| Column 7, Line 54: | "damperer" should read "dampener" |
| Column 7, Line 64: | "end" should read "and" |
| Column 8, Line 3: | "on" should read "or" |
| Column 8, Line 19: | "mateial" should read "material" |
| Column 8, Line 20: | "THe" should read "The" |
| Column 8, Line 24: | "Referng" should read "Referring" |
| Column 8, Line 27: | "container 38" should read "container 48" |
| Column 8, Line 58: | "ceratain" should read "certain" |
| Column 9, Line 6: | "distributionrollers" should read "distribution rollers" |
| Column 9, Line 14: | "unevely" should read "unevenly" |
| Column 9, Line 48: | "dispered" should read "dispersed" |
| Column 9, Line 48: | "beanded" should read "beaded" |
| Column 10, Line 9: | "Resistance" should read "resistant" |
| Column 10, Line 15: | "frequence" should read "frequent" |
| Column 10, Line 18: | "printingcapability" should read "printing capability" |
| Column 10, Line 31: | "simple" should read "simply" |
| Column 10, Line 41: | "three-sixteenth" should read "three-sixteenths" |

UNITED STATES PATENT OFFICE
CERTIFICATE OF CORRECTION

Patent No. 4,022,125 Dated May 10, 1977

Inventor(s) Gaylon N. Weaver

It is certified that error appears in the above-identified patent and that said Letters Patent are hereby corrected as shown below:

| | |
|---|---|
| Column 11, Line 50: | "having" should read "being" |
| Column 11, Line 51: | "damping" should read "dampening" |
| Column 11, Line 65: | "abosrbent" should read "absorbent" |
| Column 12, Line 10: | "evenyl" should read "evenly" |
| Column 13, Line 1: | Between "roller" and "supported" insert "being" |
| Column 14, Line 17: | "support" should read "supported" |

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*